US007171356B2

(12) United States Patent
Deisher et al.

(10) Patent No.: US 7,171,356 B2
(45) Date of Patent: Jan. 30, 2007

(54) LOW-POWER NOISE CHARACTERIZATION OVER A DISTRIBUTED SPEECH RECOGNITION CHANNEL

(75) Inventors: Michael E Deisher, Hillsboro, OR (US); Robert W Morris, Atlanta, GA (US)

(73) Assignee: Intel Corporation, Santa Clara, CA (US)

( * ) Notice: Subject to any disclaimer, the term of this patent is extended or adjusted under 35 U.S.C. 154(b) by 862 days.

(21) Appl. No.: 10/185,576

(22) Filed: Jun. 28, 2002

(65) Prior Publication Data

US 2004/0002860 A1 Jan. 1, 2004

(51) Int. Cl.
*G10L 21/02* (2006.01)

(52) U.S. Cl. ..... 704/228

(58) Field of Classification Search ..... None
See application file for complete search history.

(56) References Cited

U.S. PATENT DOCUMENTS 5,475,712 A * 12/1995 Sasaki ..... 375/241
5,819,218 A * 10/1998 Hayata et al. ..... 704/233
6,092,039 A * 7/2000 Zingher ..... 704/221
6,934,650 B2 * 8/2005 Yoshida et al. ..... 702/76
2003/0046711 A1 * 3/2003 Cui et al. ..... 725/134

* cited by examiner

*Primary Examiner*—Donald L. Storm
(74) *Attorney, Agent, or Firm*—Blakely, Sokoloff, Taylor & Zafman LLP

(57) ABSTRACT

A distributed speech recognition system includes a noise floor estimator to provide a noise floor estimate to a feature extractor which provides a parametric representation of the noise floor estimate. An encoder is included to to generate an encoded parametric representation of the noise floor estimate. A front-end controller is also included to determine when at least one of the noise floor estimator, the feature extractor, and the encoder is to be turned on or off and to determine when the noise floor estimator is to provide the noise floor estimate to the feature extractor. Additionally, a decoder is included to generate a decoded parametric representation of the noise floor estimate. A noise model generator creates a statistical model of noise feature vectors based on the decoded parametric representation of the noise floor estimate.

25 Claims, 6 Drawing Sheets

A distributed speech recognition system incorporating a noise estimation package 100

LOW-POWER NOISE CHARACTERIZATION OVER A DISTRIBUTED SPEECH RECOGNITION CHANNEL

BACKGROUND

1. Technical Field

An embodiment of the present invention generally relates to a distributed speech recognition system. More particularly, an embodiment of the present invention relates to a distributed speech recognition system that creates a statistical model of a noise vector.

2. Discussion of the Related Art

Although distributed speech recognition ("DSR") is not a new concept, it has only recently been formalized through the European Telecommunications Standardization Institute ("ETSI") Aurora standard, ETSI ES 201 108 V1.1.2 (2000–04), published April 2000. Thus, few (if any) commercial DSR systems currently exist.

DSR systems that have mobile clients with embedded microphones, as opposed to head-worn microphones, encounter significant acoustic background noise. Parallel model combination ("PMC") is an attractive approach to combat such noise; however, to be effective, PMC requires a good estimate of the background noise. An example of a PMC method is specified in M. F. J. Gales and S. J. Young, "A Fast and Flexible Implementation of Parallel Model Combination," *Proc. International Conference on Acoustics Speech and Signal Processing* ("*ICASSP*") '95, May 1995, pp. 133–136.

DSR systems using PMC require a sufficient number of noise feature vectors in order to accurately model noise and to accurately adjust acoustic models. A feature signal waveform. In other words, the feature vector may be described as a parametric representation of the given time-segment of the signal waveform. Noise feature vectors are typically separated in time from speech feature vectors by applying a voice activity detector. The number of noise feature vectors required for PMC, for example, may have a significant impact on a DSR client's battery life, particularly in time-varying acoustic environments where frequent noise model updates are necessary. Providing a higher number of noise feature vectors consumes more transmission bandwidth and may require a system's radio transmitter to run more frequently and/or for longer duration, thereby draining the system's battery more quickly. Similarly, if the system continuously runs an analog-to-digital ("A/D") converter to measure the noise floor, the battery life will be reduced.

DETAILED DESCRIPTION

Reference in the specification to "one embodiment", "an embodiment", or "another embodiment" of the present invention means that a particular feature, structure or characteristic described in connection with the embodiment is included in at least one embodiment of the present invention. Thus, the appearances of the phrase "in one embodiment" or "according to an embodiment", for example, appearing in various places throughout the specification are not necessarily all referring to the same embodiment. Likewise, appearances of the phrase "in another embodiment" or "according to yet another embodiment", for example, appearing in various places throughout the specification are not necessarily referring to different embodiments.

Figure 1:
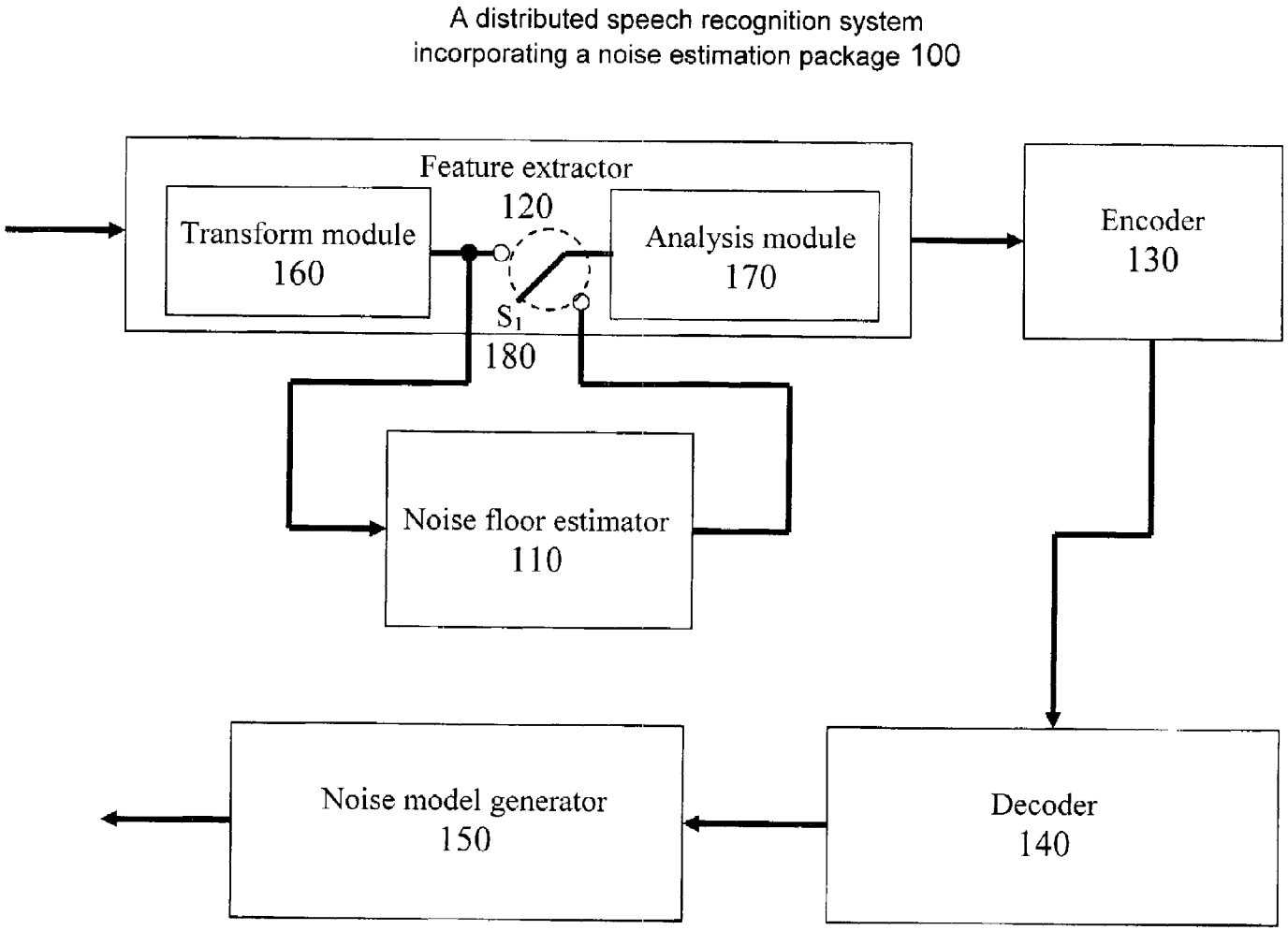
FIG. 1 illustrates a distributed speech recognition system incorporating a noise estimation package according to an embodiment of the present invention.

FIG. 1 illustrates a distributed speech recognition system incorporating a noise estimation package according to an embodiment of the present invention. The distributed speech recognition system incorporating a noise estimation package 100 includes a noise floor estimator 110, a feature extractor 120, an encoder 130, a decoder 140, and a noise model generator 150. The noise floor estimator 110 provides a noise floor estimate to the feature extractor 120. The noise floor estimate may be a spectral representation of an average noise floor for a segment of an acoustic waveform. A noise floor estimate may be provided when the noise floor has changed significantly since a previous noise floor estimate was provided. The noise floor estimator 110 may be selectively coupled between a transform module 160 and an analysis module 170 of the feature extractor 120. For example, a switch, $S_1$, 180 may selectively couple the analysis module 170 to the noise floor estimator 110. The transform module 160 may perform a sub-band windowed frequency analysis on the acoustic waveform. For example, the transform module 160 may perform filtering and discrete Fourier transforming. The analysis module 170 may perform a data reduction transform (e.g., linear discriminant analysis, principal component analysis) on sub-bands of the acoustic waveform. For example, the analysis module may perform Mel-scale windowing. The feature extractor 120 provides a parametric representation of the noise floor estimate and/or speech. The feature extractor 120 generally provides the parametric representation of the noise floor estimate during a period of speech inactivity. The encoder 130 encodes the parametric representation of the noise floor estimate and/or speech and generates an encoded parametric representation. The decoder 140 decodes the encoded parametric representation and generates a decoded parametric representation. The noise model generator 150 creates a statistical model of noise feature vectors based on the decoded parametric representation of the noise floor estimate.

According to embodiments of the present invention, the distributed speech recognition system incorporating a noise estimation package 100 may further include a front-end controller 210 (see FIG. 2) to determine when at least one of the noise floor estimator 110, the feature extractor 120, and the encoder 130 is to be turned on or off. The front-end controller 210 may determine when the noise floor estimator 110 is to provide the noise floor estimate to the feature extractor 120.

In embodiments, the distributed speech recognition system incorporating a noise estimation package 100 may utilize an acoustic model adaptation technique, such as parallel model combination ("PMC"). PMC generally requires a mean noise feature vector and a corresponding covariance matrix to be computed. In a straightforward DSR implementation, the mean noise feature vector and the corresponding covariance matrix are typically computed on a client and transmitted to a server. However, because this information differs in structure from a feature vector, special accommodations may be required in the packet structure and/or the transport protocol to carry this information. Embodiments of the present invention do not have such a limitation. For example, the system may include a noise floor estimator 110 that provides a noise floor estimate that is the mean squared magnitude of the discrete Fourier transform of a windowed, filtered noise signal. If the noise floor estimator 110 produces estimates of the magnitude-squared spectral components, the magnitude-squared spectrum may be transformed into a "feature vector" and encoded according to the ETSI Aurora standard. From this single vector, the noise model generator 150 may create a statistical model of noise feature vectors. In creating the statistical model, it may be assumed that the noise feature vectors have a Gaussian distribution. In other words, it may be assumed that the statistical model need only consist of the mean noise feature vector and the corresponding covariance matrix.

The noise model generator 150 may calculate an inverse discrete cosine transform ("DCT") of a noise feature vector to obtain the log-spectral components:

$$\hat{f}_k = \log\left\{\sum_i W_k(i)\sqrt{E\left[|N(i)|^2\right]}\right\}$$

wherein N(i) is a noise sample and $W_k(i)$ is weight for noise sample N(i) at the $k^{th}$ frame. To obtain the mean and variance of $f_k$, it may be assumed that all of the frequency components used in the weighted sum are identically distributed:

$$p(N(i)) = N(0, \sigma_k^2)$$

wherein p( ) is probability density function for N(i), and $N(0,\sigma^2)$ is a normal distribution. This assumption allows for the following simplification:

$$\hat{f}_k \approx \log\left\{\sum_i W_k(i)\right\} + \frac{1}{2}\log\{\sigma_k^2\}$$

Solving for the noise variance yields:

$$\sigma_k^2 = \left(\frac{\exp(f_k)}{\sum_i W_k(i)}\right)^2$$

With the noise distribution calculated, samples of the log-spectrum may be generated:

$$f_k = \log\left\{\sum_i W_k(i)|N(i)|\right\}$$

where the different N(i) may be synthetically generated Gaussian random variables. To obtain Mel-cepstrum samples, the DCT of the log-spectrum samples may be calculated. For further information on Mel-cepstrum coefficients, see S. B. Davis and P. Mermelstein, "Comparison of parametric representations for monosyllabic word recognition in continuously spoken sentences", IEEE Transactions on Acoustic, Speech, and Signal Processing, Vol. 28, No. 4, August 1980, pp. 357–366. The means and variances of the Mel-cepstrum samples may be calculated to create the full noise model. The preceding discussion merely illustrates one embodiment of the invention and should not be construed as a limitation on the claimed subject matter.

Figure 2:
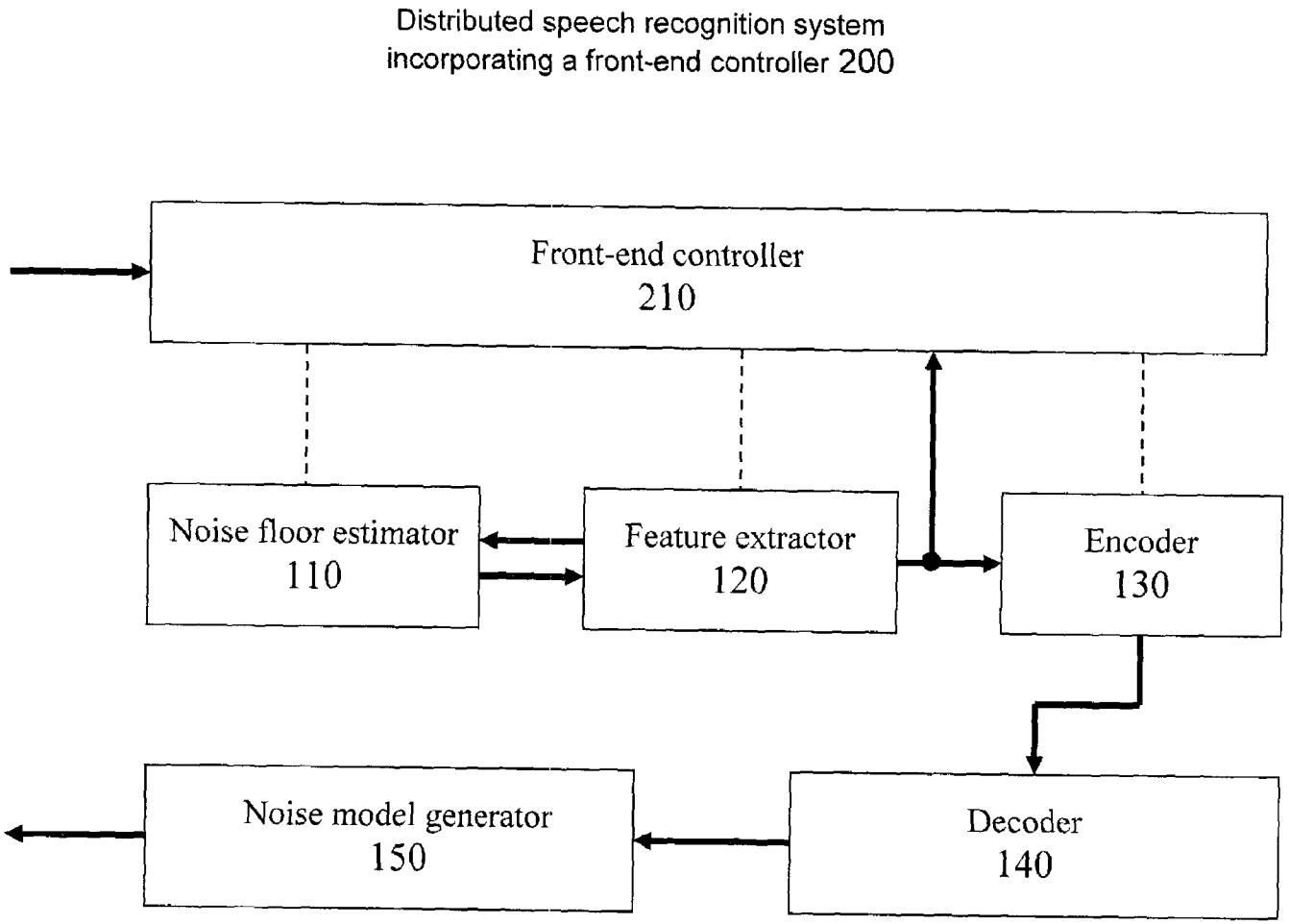
FIG. 2 illustrates a distributed speech recognition system incorporating a front-end controller according to an embodiment of the present invention.

FIG. 2 illustrates a distributed speech recognition system incorporating a front-end controller according to an embodiment of the present invention. The distributed speech recognition system incorporating a front-end controller 200 includes a noise floor estimator 110, a feature extractor 120, an encoder 130, a front-end controller 210, a decoder 140, and a noise model generator 150. The noise floor estimator 110 provides a noise floor estimate to the feature extractor 120. The feature extractor 120 provides a parametric representation of the noise floor estimate. The encoder 130 encodes the parametric representation of the noise floor estimate and generates an encoded parametric representation of the noise floor estimate. The front-end controller 210 may determine when to turn the noise floor estimator 110, the feature extractor 120, and/or the encoder 130 on or off. The decoder 140 decodes the encoded parametric representation of the noise floor estimate and generates a decoded parametric representation of the noise floor estimate. The noise model generator 150 creates a statistical model of noise feature vectors based on the decoded parametric representation of the noise floor estimate.

According to an embodiment of the present invention, the distributed speech recognition system incorporating a front-end controller 200 may further include a speech/noise de-multiplexer 310 (see FIG. 3) to determine whether received data includes noise. The decoder may be adapted to decode a packet having a start sync sequence and an end sync sequence. The received data may include a decoded packet or a group of decoded packets that are received from the decoder 140. For example, if the received data consists of a single packet, having a start sync sequence and an end sync sequence, the speech/noise de-multiplexer 310 may determine that the received data includes noise. Received data that includes speech generally includes a plurality of packets; thus, the start sync sequence and the end sync sequence typically are not within a single packet. The received data may include the decoded parametric representation of the noise floor estimate. In an embodiment, the distributed speech recognition system incorporating a front-end controller 200 may utilize an acoustic model adaptation technique, such as parallel model combination.

According to an embodiment, the distributed speech recognition system incorporating a front-end controller 200 may support three power modes: (1) super low power mode, (2) low power mode, and (3) moderate power mode. Under super low power mode, noise estimation and feature extraction components may start running when speech activity is asserted and may continue to run for $T_{ne}$ seconds after speech activity ends. The encoder 130 may run during speech activity and may be enabled again $T_{ne}$ seconds after speech activity ends in order to encode the noise floor estimate. A single noise floor estimate may be sent $T_{ne}$ seconds after speech activity ends if the noise floor has changed significantly since the previous update. Under the low power mode, all components may start running when speech activity is asserted and may stop running when speech activity ends. When speech activity is not asserted, the noise floor estimator 110 and feature extractor 120 may "wake up" every $T_W$ seconds and may run for $T_{ne}$ seconds. The encoder 130 may be run at the end of each cycle in order to encode and send the noise floor estimate if it has changed significantly since the previous update. Under moderate power mode, all components may run when speech-enabled applications are running in the foreground on a DSR client, for example. The encoder 130 may only run during speech activity and when noise floor updates are sent. When speech activity is not asserted, the noise floor estimate may be tested every $T_W$ seconds. If the noise floor estimate has changed significantly since the previous update, then the noise floor estimate may be encoded and sent. In an embodiment, the speech activity decision may come from a push-to-talk ("PTT") switch or from a voice activity detection ("VAD") algorithm. The test for significant change in the noise floor may be the weighted relative $L_n$ norm of the difference between a current feature vector and a current noise floor vector with respect to a threshold, where $L_n(x,y)=[\Sigma_k(|x_k-y_k|^p]^{(1/p)}$. In the foregoing equation, if p=2, then $L_n$ represents the Euclidean distance between vectors x and y. This criterion merely illustrates one embodiment of the present invention and should not be construed as a limitation on the claimed subject matter.

Figure 3:
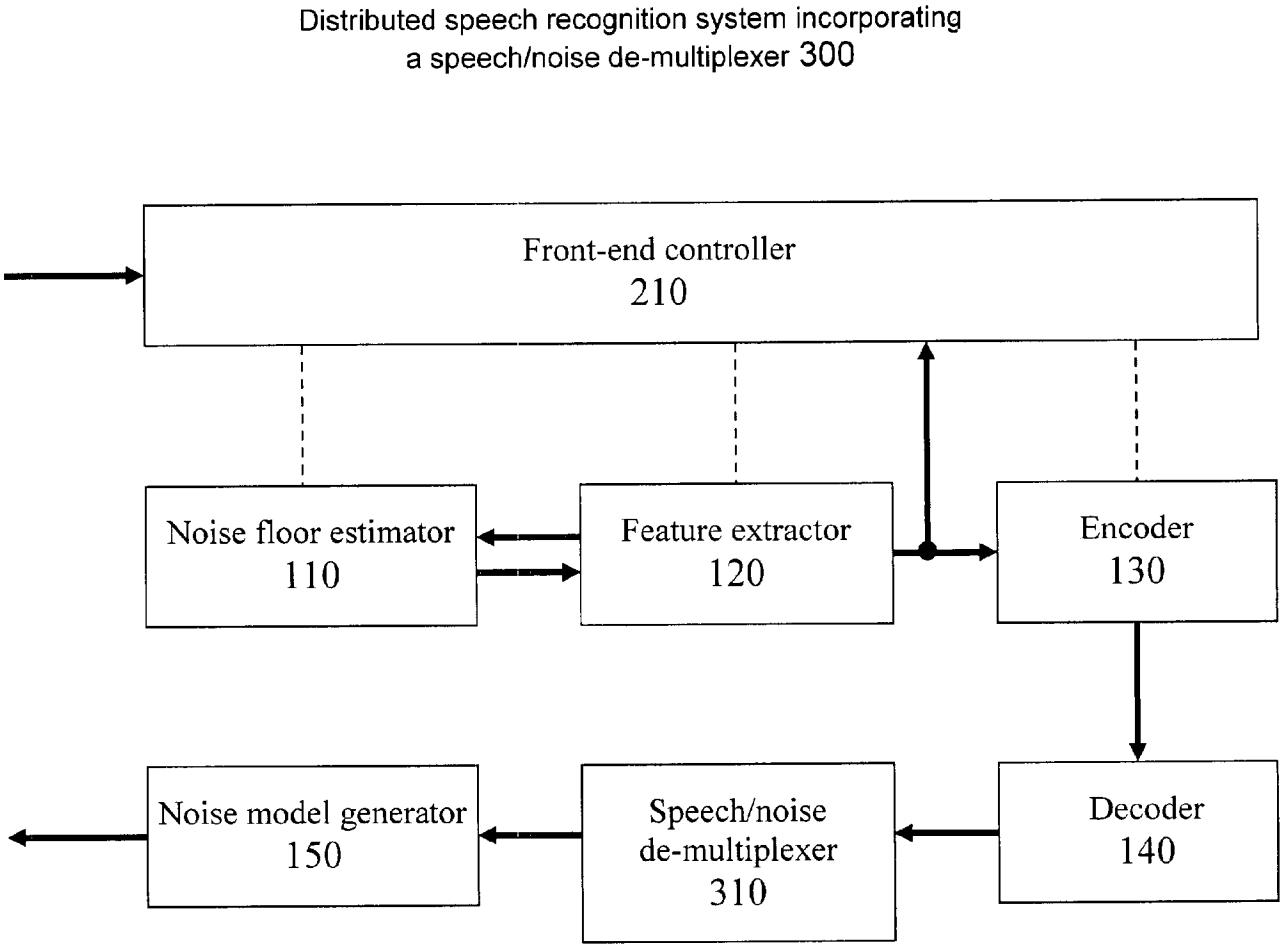
FIG. 3 illustrates a distributed speech recognition system incorporating a speech/noise de-multiplexer according to an embodiment of the present invention.

FIG. 3 illustrates a distributed speech recognition system incorporating a speech/noise de-multiplexer according to an embodiment of the present invention. The distributed speech recognition system incorporating a speech/noise de-multiplexer 300 includes a noise floor estimator 110, a feature extractor 120, an encoder 130, a decoder 140, a speech/noise de-multiplexer 310, and a noise model generator 150. The noise floor estimator 110 provides a noise floor estimate to the feature extractor 120. The feature extractor 120 provides a parametric representation of the noise floor estimate. The encoder 130 encodes the parametric representation of the noise floor estimate and generates an encoded parametric representation of the noise floor estimate. Decoders generally reject utterances that consist of a single packet. However, because the encoded parametric representation of the noise floor estimate may fit in a single packet, it may be sent in a packet having both a start sync sequence and an end sync sequence. Thus, the decoder 140 may be adapted to decode a packet having a start sync sequence and an end sync sequence. The decoder 140 generates a decoded parametric representation of the noise floor estimate. The speech/noise de-multiplexer 310 determines whether received data represents noise. The received data may include the decoded parametric representation of the noise floor estimate. The de-multiplexer 310 may make its determination without employing side information by detecting a length of a packet. This technique may operate with protocols that provide no mechanism for side information, for example, the Aurora standard. The noise model generator 150 creates a statistical model of noise feature vectors based on the decoded parametric representation of the noise floor estimate.

According to an embodiment of the present invention, the distributed speech recognition system incorporating a speech/noise de-multiplexer 300 may utilize an acoustic model adaptation technique, such as a parallel model combination technique. In an embodiment, the noise floor estimator 110 may be selectively coupled between a transform module 160 (see FIG. 1) and an analysis module 170 of the feature extractor 120.

Figure 4A:
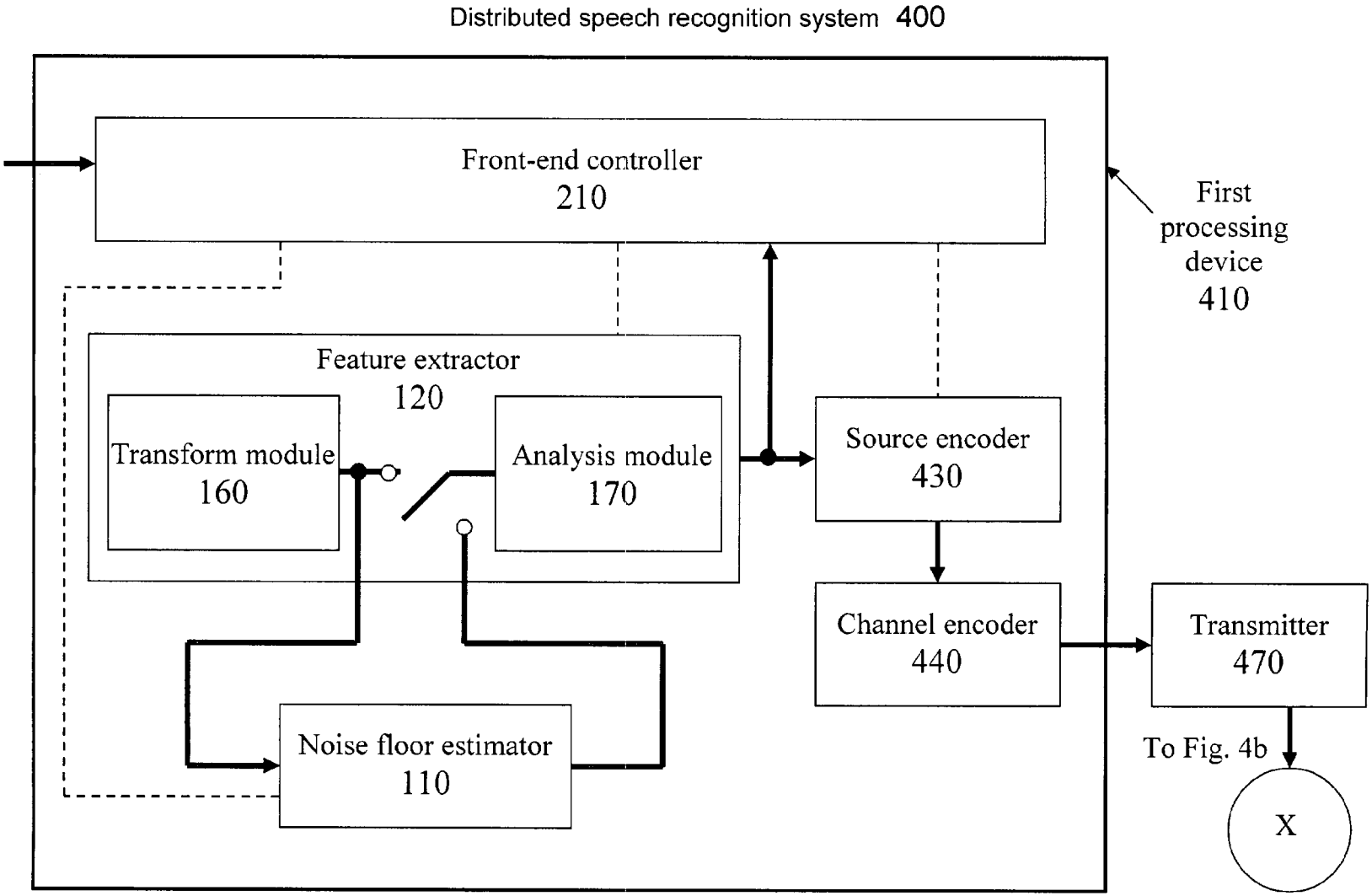
FIGS. 4*a* and 4*b* illustrate a distributed speech recognition system according to an embodiment of the present invention.
Figure 4B:
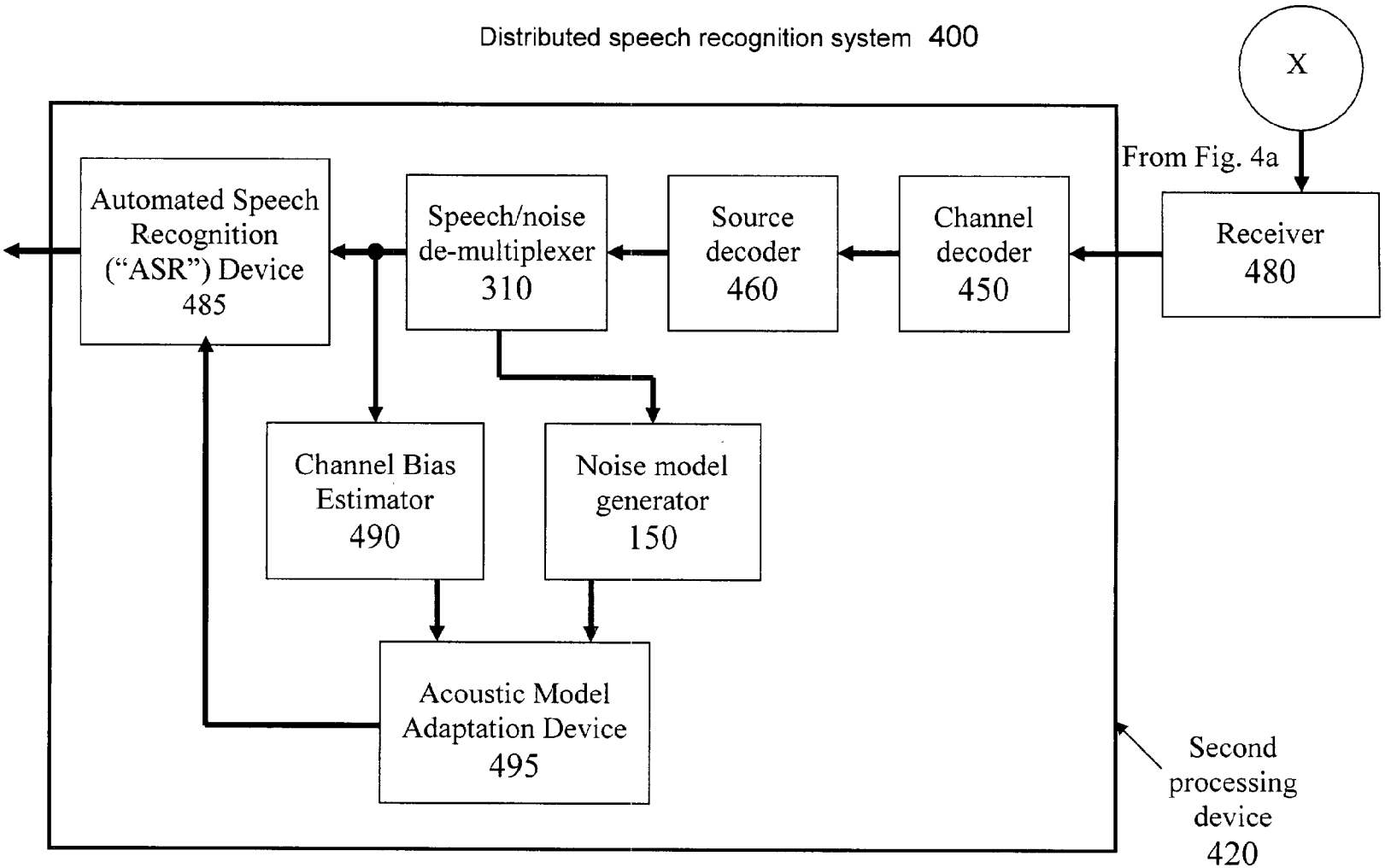

FIGS. 4*a* and 4*b* illustrate a distributed speech recognition system according to an embodiment of the present invention. The distributed speech recognition system 400 may include a first processing device 410 (e.g., a DSR client) and a second processing device 420 (e.g., a server). The first processing device 410 may include a noise floor estimator 110, a feature extractor 120, a source encoder 430, a channel encoder 440, and a front-end controller 210. The noise floor estimator 110 provides a noise floor estimate to the feature extractor 120. The noise floor estimator 110 may be selectively coupled between a transform module 160 and an analysis module 170 of the feature extractor 120. The feature extractor 120 provides a parametric representation of the noise floor estimate. The source encoder 430 may compress the parametric representation of the noise floor estimate and generate an encoded parametric representation of the noise floor estimate. The channel encoder 440 may protect against bit errors in the encoded parametric representation of the noise floor estimate. The front-end controller 210 may determine when at least one of the noise floor estimator 110, the feature extractor 120, and the source encoder 430 is to be turned on or off. The front-end controller 210 may also determine when the noise floor estimator 110 is to provide the noise floor estimate. The second processing device 420 may include a channel decoder 450, a source decoder 460, a speech/noise de-multiplexer 310, and a noise model generator 150. The channel decoder 450 may be adapted to decode a packet structure. The packet structure may include a packet having a start sync sequence and an end sync sequence. The source decoder 460 may decompress the encoded parametric representation of the noise floor estimate and generate a decoded parametric representation of the noise floor estimate. The speech/noise de-multiplexer 310 may determine whether received data represents noise. The received data may include the decoded parametric representation of the noise floor estimate. The noise model generator 150 creates a statistical model of noise feature vectors based on the decoded parametric representation of the noise floor estimate.

According to an embodiment of the present invention, the distributed speech recognition system 400 may incorporate parallel model combination. For example, parallel model combination may be incorporated on the second processing device 420. The speech/noise de-multiplexer 310 may be connected to an automated speech recognition ("ASR") device 485 and to a channel bias estimator 490. The channel bias estimator 490 may be connected to an acoustic model adaptation device 495. For example, the acoustic model adaptation device 495 may be a parallel model combination ("PMC") device. The noise model generator 150 may be connected to the acoustic model adaptation device 495. The acoustic model adaptation device 495 may be connected to the ASR device 485. The ASR device 485 may provide a text output.

In an embodiment, the distributed speech recognition system 400 may further include a transmitter 470 to transmit the encoded parametric representation of the noise floor estimate and a receiver 480 to receive the encoded parametric representation of the noise floor estimate from the transmitter 470. According to an embodiment, the transmitter 470 and the first processing device 410 may form a single device. In an embodiment, the receiver 480 and the second processing device 420 may form a single device.

According to an embodiment, the first processing device 410 may be a handheld computer. According to another embodiment, the second processing device may be a server computer. In another embodiment, the source encoder 430 and the channel encoder 440 may form a single device. In yet another embodiment, the source decoder 460 and the channel decoder 450 may form a single device. In still another embodiment, the first processing device 410 and the second processing device 420 may form a single device.

Figure 5:
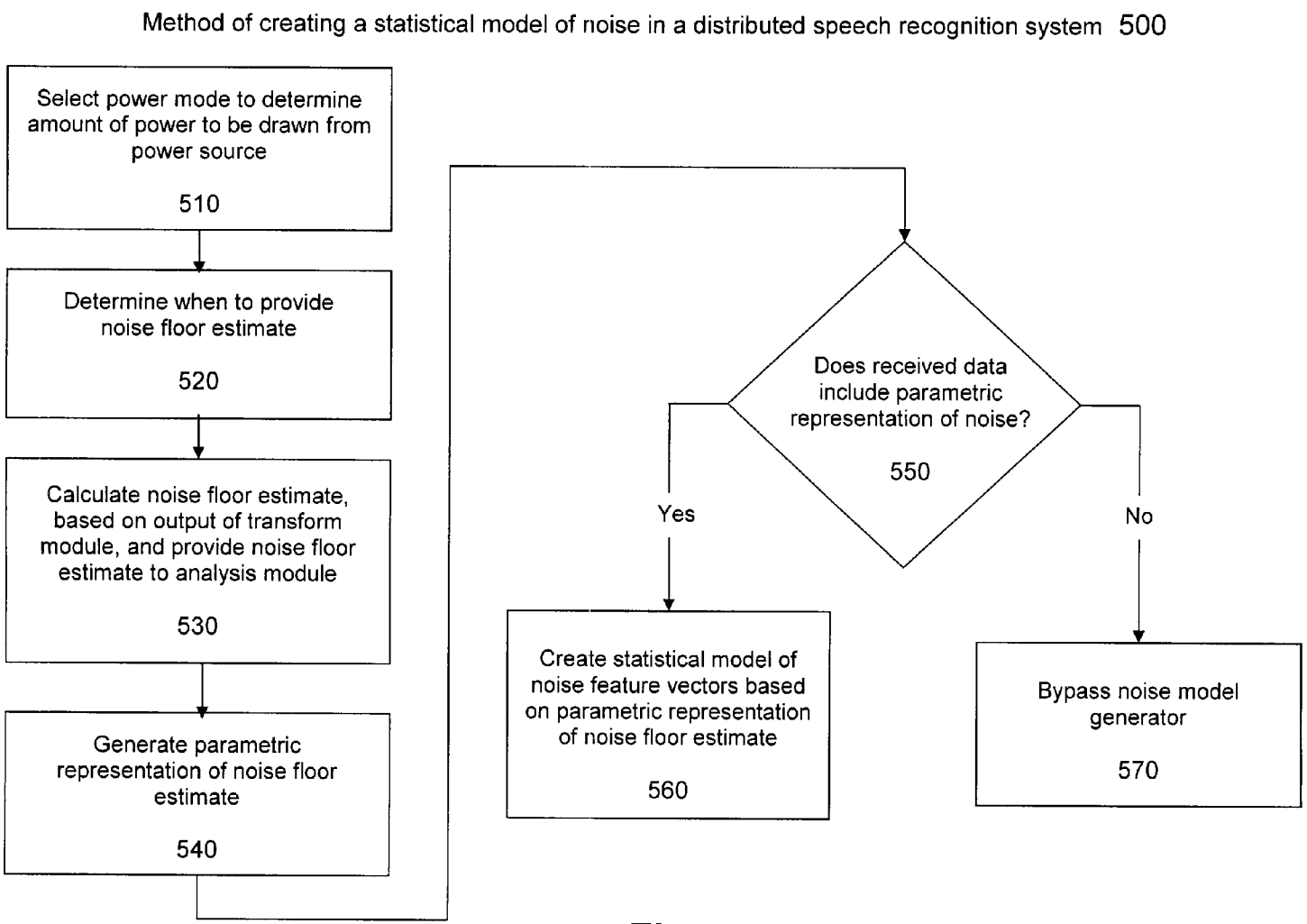
FIG. 5 illustrates a flow chart for a method of creating a statistical model of noise in a distributed speech recognition system according to an embodiment of the present invention.

FIG. 5 illustrates a flow chart for a method of creating a statistical model of noise in a distributed speech recognition system according to an embodiment of the present invention. Within the method and referring to FIGS. 4*a* and 4*b*, a front-end controller 210 may select 510 a power mode to determine an amount of power to be drawn from a power source. The front-end controller 210 may determine 520 when to provide a noise floor estimate. The noise floor estimate may be calculated 530, based on an output of a transform module 160 (see FIG. 1), and provided to an analysis module 170. A noise floor estimator 110 may be selectively coupled between the transform module 160 and the analysis module 170. The noise floor estimator 110 is generally coupled between the transform module 160 and the analysis module 170 by a switch, $S_1$, 180 (see FIG. 1) if the front-end controller 210 determines that a noise floor estimate is to be provided. A feature extractor 120 may generate 540 a parametric representation of the noise floor estimate. The feature extractor 120 may generate a parametric representation of speech. A speech/noise de-multiplexer 310 may determine 550 whether received data includes a parametric representation of noise. For example, the speech/noise de-multiplexer 310 may determine whether the received data includes a packet, having a start sync sequence and an end sync sequence. The received data may include the parametric representation of the noise floor estimate. If the received data represents noise, then a noise model generator 150 may create 560 a statistical model of noise feature vectors based on the parametric representation of the noise floor estimate. If the received data does not represent noise, then the noise model generator 150 may be bypassed 570, and the received data, which may represent speech, may be routed to an ASR device 485 (see FIG. 4*b*).

According to an embodiment of the present invention, the method may utilize an acoustic model adaptation technique. For example, an acoustic model adaptation device 495 may be used. In an embodiment, the acoustic model adaptation technique may be a parallel model combination technique. In an embodiment, the method may further include decoding the packet. In another embodiment, creating the statistical model of the noise feature vectors may include providing a mean and a variance of a Mel-cepstrum vector.

In short, the distributed speech recognition system 400 according to an embodiment of the present invention may estimate the noise floor on the first processing device 410 and disguise the noise floor estimate as a feature vector. This scheme allows a single feature vector to be sent per noise model update, as opposed to sending many feature vectors and allowing the second processing device 420 to perform noise floor estimation. Thus, the problems of excess battery drain from the first processing device 410 and excess transmission bandwidth may be avoided. Moreover, to avoid excess battery drain due to continuously running an A/D converter on the first processing device 410, the distributed speech recognition system 400 provides a mechanism to briefly run the A/D converter at regular intervals to keep the noise floor estimate updated.

A feature vector may comprise a mean, a variance, a delta mean, a delta variance, a delta-delta mean, a delta-delta variance, and so on, where "delta" represents a first derivative of the feature vector and "delta-delta" represents a second derivative of the feature vector. Although the disguised noise floor estimate may be useful only to update the various mean components of the noise feature, the noise model generator 150 on the second processing device 420 may use a Monte-Carlo method to regenerate the different variance components of the noise feature. Furthermore, the disguised noise floor estimate may be transported over an existing Aurora 1.0 compliant transport, for example, without special modifications to the transport protocol.

While the description above refers to particular embodiments of the present invention, it will be understood that many modifications may be made without departing from the spirit thereof. The accompanying claims are intended to cover such modifications as would fall within the true scope and spirit of an embodiment of the present invention. The presently disclosed embodiments are therefore to be considered in all respects as illustrative and not restrictive, the scope of an embodiment of the invention being indicated by the appended claims, rather than the foregoing description, and all changes that come within the meaning and range of equivalency of the claims are therefore intended to be embraced therein.

What is claimed is:

1. A method of creating a statistical model of noise in a distributed speech recognition system, comprising:

selecting one of a first power mode, a second power mode, and a third power mode to determine an amount of power to be drawn from a power source:

determining when to provide a noise floor estimate based at least in part on the selected power mode;

generating a parametric representation of the noise floor estimate when the noise floor estimate is provided;

determining whether received data includes a parametric representation of noise; and creating a statistical model of noise feature vectors based on the parametric representation of the noise floor estimate;

wherein the first power mode involves activating noise estimation and feature extraction components upon assertion of speech activity, the second power mode involves deactivating the noise estimation and feature extraction components after the speech activity ends, and a third power mode involves activating noise estimation and feature extraction components upon assertion of speech activity and allowing the noise estimation and feature extraction components to remain active as long as a speech-enabled application remains active.

2. The method according to claim 1, wherein determining whether the received data includes the parametric representation of noise comprises determining whether the received data includes a packet with a start sync sequence and an end sync sequence.

3. The method according to claim 1, further comprising calculating the noise floor estimate, based on an output from a transform module, and providing the noise floor estimate to an analysis module.

4. The method according to claim 1, wherein the received data includes the parametric representation of the noise floor estimate.

5. The method according to claim 1, wherein the statistical model of noise is used for acoustic model adaptation.

6. The method according to claim 1, wherein the second power mode further involves enabling the noise estimation and feature extraction components during intervals when speech is not present.

7. The method according to claim 1, wherein creating the statistical model of the noise feature vectors includes providing a mean and a variance of a Mel-cepstrum vector.

8. An article comprising:

a computer-readable storage medium having stored thereon computer-executable instructions that when executed by a machine result in the following:

selecting one of a first power mode, a second power mode, and a third power mode to determine an amount of power to be drawn from a power source;

determining when to provide a noise floor estimate based at least in part on the selected power mode;

generating a parametric representation of the noise floor estimate when the noise floor estimate is provided;

determining whether received data includes a parametric representation of noise; and creating a statistical model of noise feature vectors based on the parametric representation of the noise floor estimate;

wherein the first power mode involves activating noise estimation and feature extraction components upon assertion of speech activity, the second power mode involves deactivating the noise estimation and feature extraction components after the speech activity ends, and a third power mode involves activating noise estimation and feature extraction components upon assertion of speech activity and allowing the noise estimation and feature extraction components to remain active as lone as a speech-enabled application remains active.

9. The article according to claim 8, wherein determining whether the received data includes the parametric representation of noise comprises determining whether the received data includes a packet with a start sync sequence and an end sync sequence.

10. The article according to claim 8, wherein the instructions further result in calculating the noise floor estimate, based on an output from a transform module, and providing the noise floor estimate to an analysis module.

11. The article according to claim 8, wherein the received data includes the parametric representation of the noise floor estimate.

12. The article according to claim 8, wherein the statistical model of noise is used for acoustic model adaptation.

13. The article according to claim 8, wherein the second power mode further involves enabling the noise estimation and feature extraction components during intervals when speech is not present.

14. The article according to claim 8, wherein creating the statistical model of the noise feature vectors includes providing a mean and a variance of a Mel-cepstrum vector.

15. A distributed speech recognition system, comprising:

a first processing device, including:

a transform module to receive input speech, a noise floor estimator to provide a noise floor estimate for the input speech, a feature extractor to provide a parametric representation of the noise floor estimate and the input speech, and a front-end controller to select one of a first power mode, a second power mode, and a third power mode to determine an amount of power to be drawn from a power source, and to determine when the noise floor estimator provides a noise floor estimate based at least in part on the selected power mode;

a transmitter to transmit the parametric representation of the noise floor estimate and the input speech;

a receiver to receive the parametric representation of the noise floor estimate and the input speech from the transmitter; and a second processing device, including:

a noise model generator to create a statistical noise model based on the parametric representation of the noise floor estimate, and a speech recognizer to recognize the input speech based on acoustic models, the acoustic models adapted based at least in part on the statistical noise model.

16. The system according to claim 15, wherein the transmitter and the first processing device form a single device.

17. The system according to claim 15, wherein the receiver and the second processing device form a single device.

18. The system according to claim 15, wherein the first processing device comprises a handheld computer.

19. The system according to claim 15, wherein the second processing device comprises a server computer.

20. The system according to claim 15, wherein the first processing device further comprises an encoder to compress the parametric representation of the noise floor estimate and the input speech and to generate an encoded representation thereof. before the transmitter transmits the parametric representation of the noise floor estimate and the input speech to the receiver.

21. The system according to claim 20, wherein the second processing device further comprises a decoder to decompress the encoded parametric representation of the noise floor estimate and the input speech and to generate an decoded representation thereof.

22. The system according to claim 21, wherein the second processing device further comprises a speech/noise demultiplexer to receive data from the decoder and to determine whether the received data represents noise.

23. The system according to claim 21, wherein the decoder is adapted to decode a packet having a start sync sequence and an end sync sequence, the packet including the encoded parametric representation of the noise floor estimate.

24. The system according to claim 15, wherein the noise floor estimator is selectively coupled between a transform module and an analysis module, the transform module filtering an input signal, and the analysis module performing a data reduction transform.

25. The system according to claim 15, wherein the second processing device further comprises an acoustic model adapter to adapt the acoustic models using the statistical noise model.

* * * * *